United States Patent [19]

Johnson et al.

[11] 4,068,114

[45] Jan. 10, 1978

[54] HEATER SAFETY CONTROL

[75] Inventors: Philip P. Johnson, St. Joseph; Clifford L. DeSchaaf, Stevensville, both of Mich.

[73] Assignee: Whirlpool Corporation, Benton Harbor, Mich.

[21] Appl. No.: 683,951

[22] Filed: May 6, 1976

[51] Int. Cl.[2] ..... F24H 1/00

[52] U.S. Cl. ..... 219/333; 134/57 D; 134/58 D; 219/334

[58] Field of Search ..... 219/333, 334; 134/57 D, 134/57 R, 58 D, 58 R

[56] References Cited

U.S. PATENT DOCUMENTS

| | | | |
|---|---|---|---|
| 2,877,778 | 3/1959 | Kilby | 134/57 D |
| 3,160,170 | 12/1964 | Sampsel | 134/57 D X |
| 3,331,374 | 7/1967 | Stewart et al. | 134/56 D |
| 3,600,602 | 8/1971 | Yartz | 134/57 D |
| 3,846,615 | 11/1974 | Athey et al. | 219/333 |

*Primary Examiner*—C. L. Albritton

*Attorney, Agent, or Firm*—Wegner, Stellman, McCord, Wiles & Wood

[57] ABSTRACT

A receptacle such as a dishwasher tub having an improved control for effecting filling of the tub to a preselected full level and protecting the apparatus against undesirable overfill in the event the normal flow control malfunctions. The flow control includes a control valve having two valve elements for cooperatively preventing such undesirable overfill. One of the valve elements may be controlled by an electrically operated solenoid, and the other valve element may be controlled by mechanical control structure. In the illustrated embodiment, the electrically controlled valve element is controlled by a timer, and the mechanically controlled valve element is controlled by a float. A heater is provided for heating liquid in the tub and an improved control is provided for controlling the heater so as to prevent energization thereof whenever the sensed liquid volume in the tub is below a preselected minimum. Illustratively, the volume is sensed by a float sensing the level of liquid in the tub and connected to a switch of the control for selectively energizing the heater.

19 Claims, 9 Drawing Figures

FIG. 3
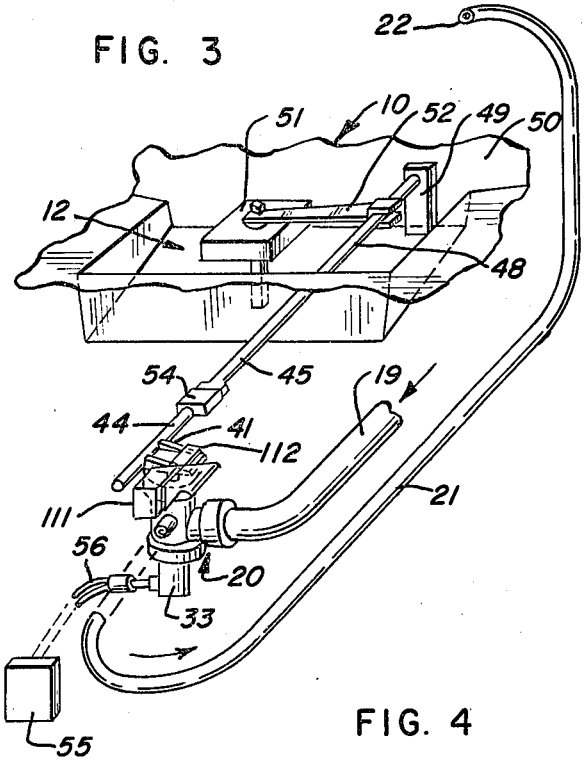
FIG. 5
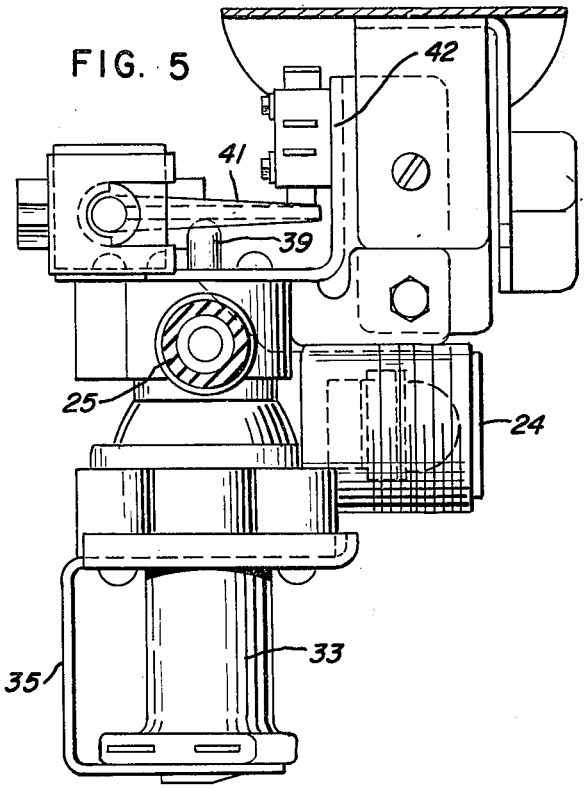
FIG. 4
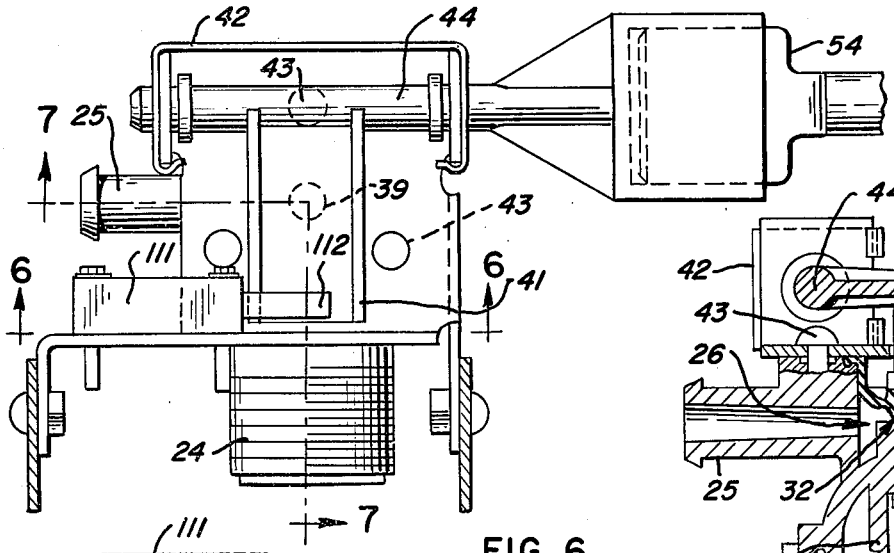
FIG. 6
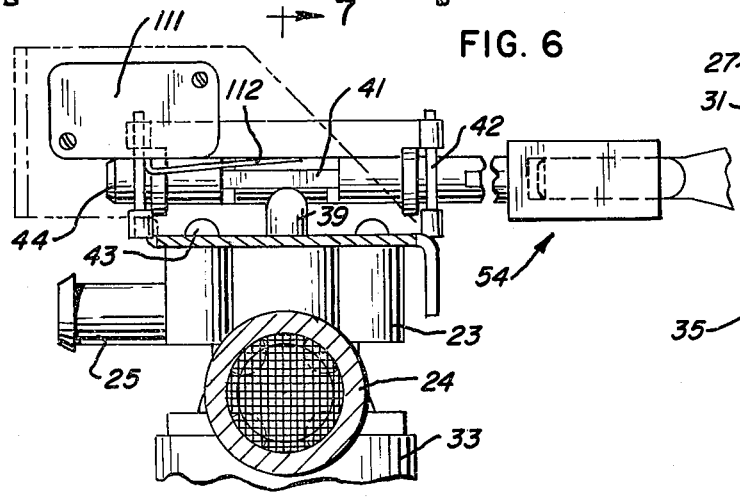
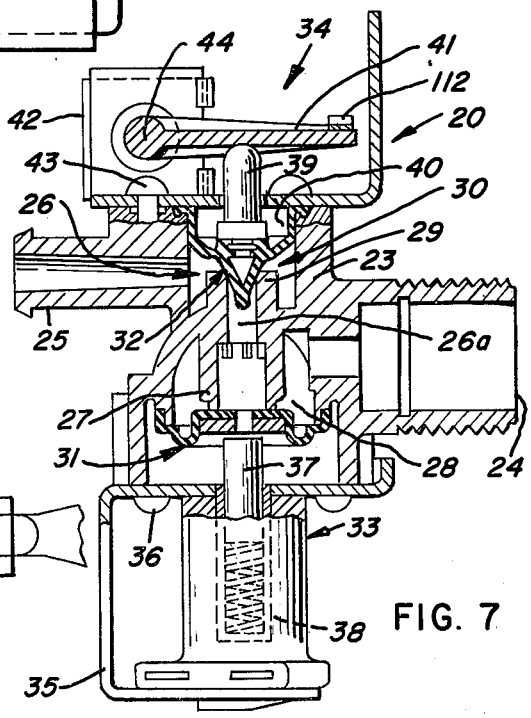
FIG. 7

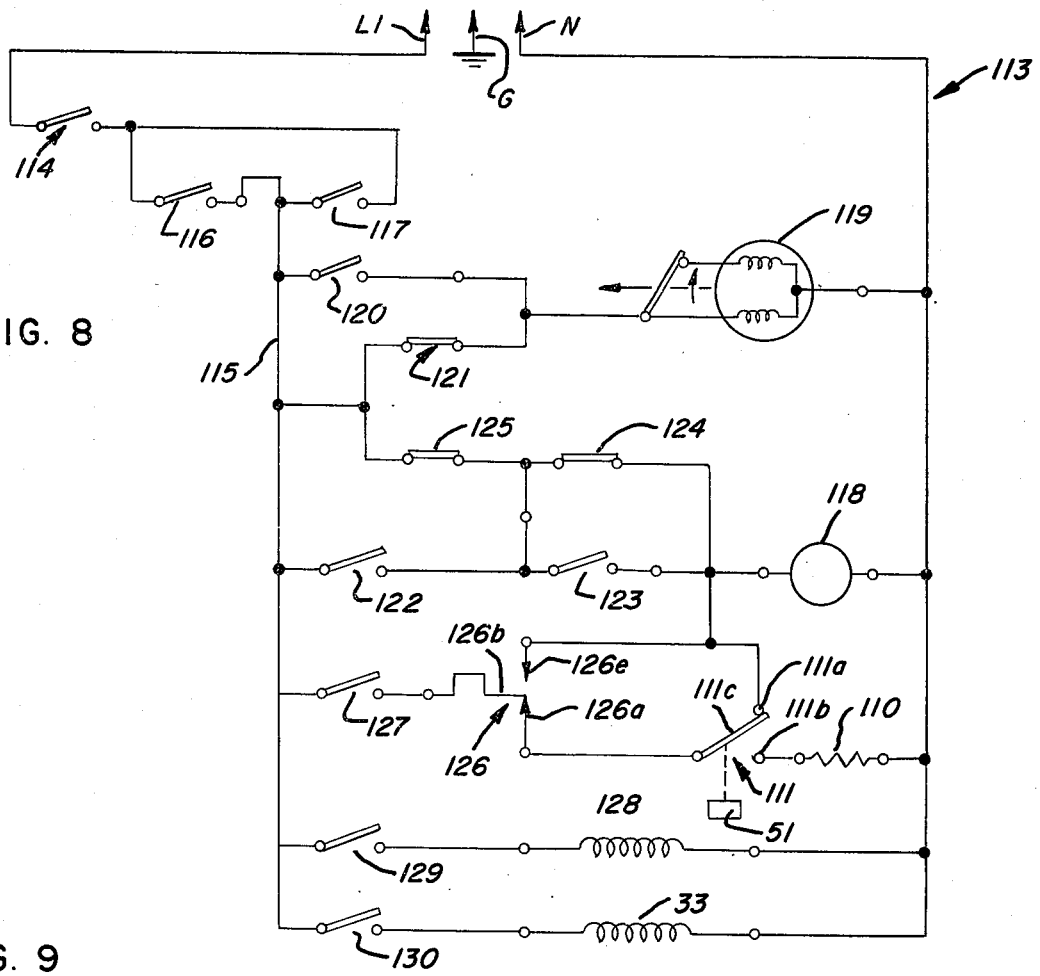
FIG. 8
FIG. 9
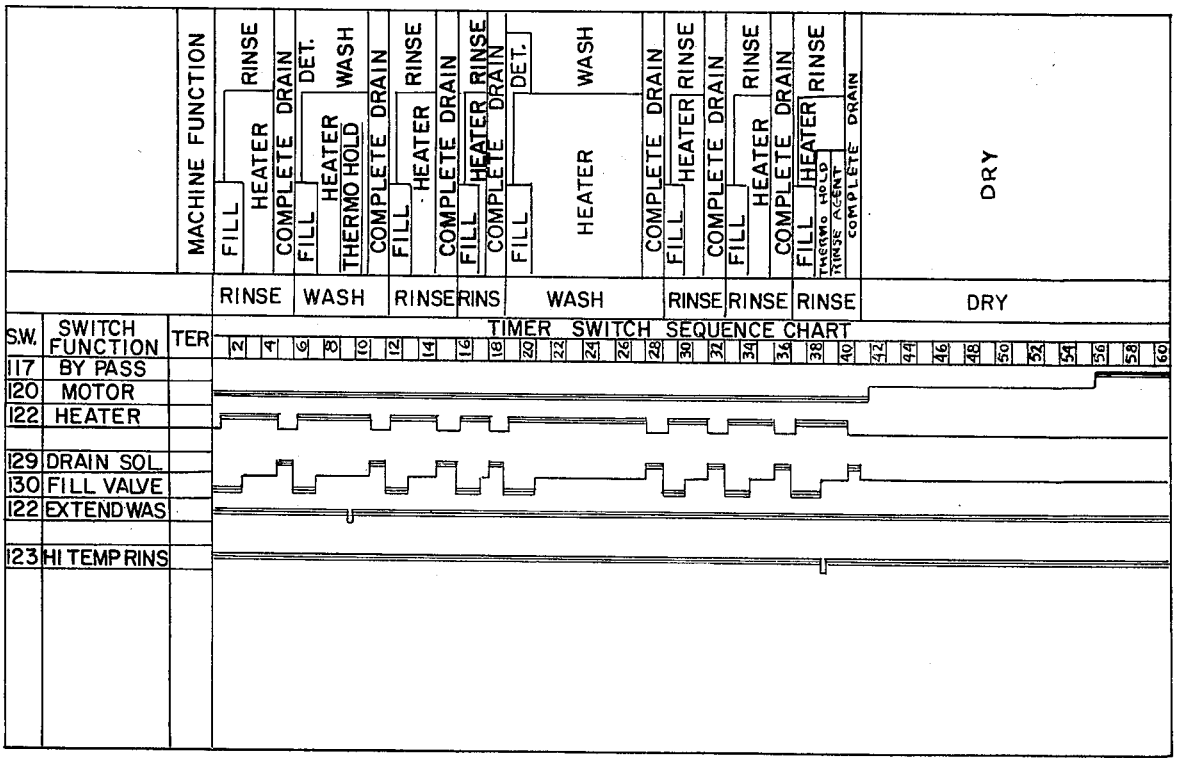

HEATER SAFETY CONTROL

BACKGROUND OF THE INVENTION

1. Field of the Invention

This invention relates to liquid flow control means, and, in particular, to means for controlling the filling of a receptacle, such as a dishwasher tub, and the heating of the liquid therein.

2. Description of the Prior Art

In one conventional dishwasher structure, a tub is provided having a sump portion in which dishwashing liquid is collected for recirculation as by being sprayed against the dishes being washed in the apparatus. The quantity of dishwashing liquid is conventionally controlled by filling the tub to a preselected normal full level from a pressurized liquid source. One example of such an apparatus is shown in U.S. Pat. No. 3,331,374 of Bruce E. Stewart et al, owned by the assignee thereof. In said patent, the liquid level and flow control includes a drain outlet and a return outlet, with a solenoid operated valve for selectively closing the drain outlet. A float is attached to the valve to open it as the result of a high liquid level condition in the tub, even though the solenoid is de-energized to prevent draining of the liquid from the tub. A heater is provided for heating the liquid during preselected cycles of the dishwashing operation.

A number of different control valves for use in controlling liquid fill in different devices are known in the art. Illustratively, a safety cutoff device for fuel supply lines shown in William C. Coleman U.S. Pat. No. 2,174,055 is used in connection with a delivery of liquid fuel to a gas burning appliance. The Coleman device utilizes a float operated linkage to close the liquid inlet valve under certain operating conditions.

Hans Erik Sebastian Hiort af Ornas discloses, in U.S. Pat. No. 2,395,968, a dishwasher having a steam generator providing means for urging the washing liquid through a sprinkler. The use of the steam provides a successive heating of the washing water so as to provide different temperatures of different portions of the washing water.

In U.S. Pat. No. 2,471,778 of Luther Ringer, a fluid responsive control apparatus is shown wherein float means are provided responding to the rising and falling of the fluid level in a container for controlling introduction and removal of the fluid relative to the container and maintaining a desired fluid level therein.

In U.S. Pat. No. 2,547,098, Carl A. Smith et al disclose an electromagnetic valve having manual means for actuating the valve in event of failure of electrical power.

Thomas B. Chace et al, in U.S. Pat. No. 2,548,651, show a fluid control system for laundering apparatus, having means for controlling the temperature of the washing liquid, and utilizing float actuated means for controlling a drain valve. A cup-shaped member is provided which operates to cut off liquid delivery, and a weight controlled unit is provided to stop delivery notwithstanding continued operation of the cup-shaped member.

Hanes E. S. Hiort af Ornas, in his subsequent U.S. Pat. No. 2,618,281, shows another dishwashing device operable by variable pressure steam to provide repeated sprinkling of the dishes in the washing chamber. In his further U.S. Pat. No. 2,621,666, Hiort af Ornas discloses a dishwashing machine having heating elements for the washing fluid container and the rinsing water vessel and means for successive heating of the washing fluid and the rinsing water.

James B. Kirby, in U. S. Pat. No. 2,877,778, shows a dishwashing machine having a manually operable mechanism for actuating a drain valve therein. A heater is provided for rapidly heating the water in the compartment to a suitable rinsing temperature. The heater is connected so as to operate only when the spray head motor is operated.

George B. Klaber, in U.S. Pat. No. 2,937,014, shows a float valve for controlling liquid delivery in a fuel supply line.

In Australian Pat. No. 263,486, of Modern Equipment Company Limited, a dishwashing machine is shown wherein a float is provided in a separate chamber adjacent the dishwasher tub for controlling energization of a heater in that chamber. The heater is controlled by a switch operated by closing of the door to the dishwashing compartment and the float when the water in the chamber reaches a preselected level. The float controls the switch so as to discontinue energization of the heater in the event the liquid level drops below a preselected level and the float may be used to control other operations of the dishwasher.

John H. Spragins, in U.S. Pat. No. 2,664,094, shows a level control for controlling the level of dishwasher liquid in a separate well communicating with the tub for providing steam into the washing compartment.

James H. Bear, in U.S. Pat. No. 3,083,717, shows a dishwashing machine having a float which energizes a heater when the water level in the heating tank reaches a preselected level. When the volume in the tank reaches the desired volume, the float de-energizes the supply valve while heating of the water continues until the water reaches a preselected temperature with a thermostat maintaining the temperature thereafter. Manual operation of a valve handle discharges the heated water into a dishwashing chamber and a pump motor is energized to effect a spraying of the dishes therein. A switch also controlled by the float disconnects the heater whenever the water level in the heating tank drops below a preselected low level while the rinse water is being withdrawn to prevent further operation of the heater subsequent to the transfer of the water from the heating tank to the dishwashing chamber.

Donald S. Cushing shows, in U.S. Pat. No. 3,439,687, a control system for an automatic dishwasher having a fluid switch ameliorating a malfunction of either the water valve or the fill switch controlling the liquid delivery to the dishwasher by de-energizing the water valve and permitting energization of a drain solenoid to open a drain valve.

In U.S. Pat. No. 3,610,271 of Wilbur W. Jarvis, owned by the assignee hereof, a variable liquid level control for use with liquid receiving devices, such as dishwashers and the like, is disclosed as being controlled by a float having a plurality of buoyant compartments, with means for varying the buoyancy of the float by selectively closing the compartments. The float operates a switch to terminate the fill operation when the liquid level in the washing chamber reaches a preselected level.

Eugene W. Scott, in U.S. Pat. No. 3,829,636, shows an overflow control dashpot-type float for a dishwasher switch assembly for controlling an externally mounted overflow switch.

In a copending application owned by the assignee hereof of Phillip P. Johnson and William T. Lampman, Ser. No. 683,952 filed May 6, 1976, concurrently herewith (PA-4870), for a Receptacle Fill Apparatus, an apparatus similar to that disclosed herein, but without the liquid heater and liquid heater control means hereof, is disclosed and claimed.

SUMMARY OF THE INVENTION

The present invention comprehends an improved means for controlling the filling of a liquid receptacle from a pressurized liquid supply and the heating of liquid therein. The present invention is illustrated with respect to a dishwasher, it being understood that the invention is adapted for use with any liquid holder receptacle means.

The development comprehends providing such an improved fill and heating control means including a control valve defining a liquid flow passage having an upstream portion and downstream portion, means for connecting the upstream portion to a pressurized liquid supply, means for delivering liquid from the downstream portion into the receptacle, the control valve including first valve means for selectively closing the upstream portion for controlling liquid delivery through the flow passage to the receptacle, and second valve means for selectively closing the downstream portion as an incident of the liquid level in the receptacle reaching a preselected full level, and means for causing liquid flow from the liquid supply to the receptacle to be terminated by the first valve means closing the upstream portion of the flow passage in the event of malfunctioning of the second valve means permitting the receptacle to be filled beyond said preselected full level.

The control valve may utilize both electrically operated and mechanically operated valve means as the two valve means thereof. In the illustrated embodiment, the first valve means comprises an electrically operated solenoid valve, and the second valve means comprises a mechanically operated float control valve.

In the illustrated embodiment, the safety cutoff of the fill is effected at the end of a preselected period of time by means of a timer associated with the solenoid valve. Illustratively, the maximum fill in the receptacle may be approximately twice that normally required to provide the preselected normal full condition.

Initiation of the liquid delivery is effected by an electrically operated valve, normal termination of the delivery is effected by a float controlled valve, and safety overfill limit is provided by the electrically operated valve under the control of timer means.

The invention comprehends providing, in such a dishwasher apparatus, means for heating liquid in the dishwasher tub and switch means controlled by the liquid volume sensing means for preventing energization of the heater means whenever the sensed liquid volume corresponding to the liquid level in the washing chamber is below a preselected minimum.

The control may include a timer means for controlling the fill means to provide a preselected filling of the receptacle and effecting operation of the apparatus through an overall operation cycle. The switch means controlled by the volume sensing means ensures a continuous running of the timer means to cause the overall operation cycle notwithstanding the sensed liquid volume dropping to below a preselected minimum level. The switch means may further cause the heater means to be deenergized whenever the liquid volume is below the preselected level notwithstanding the continued operation of the apparatus under the above described control of the switch means to complete the overall operation cycle without further energization of the heater means.

Thus, the apparatus of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein:

FIG. 3 is a perspective view thereof;

FIG. 4 is a side elevation of the valve means thereof;

FIG. 5 is an end elevation thereof;

FIG. 6 is a rear elevation thereof, taken substantially along the line 6—6 of FIG. 4;

FIG. 7 is a vertical section taken substantially along the line 7—7 of FIG. 4;

FIG. 8 is a schematic wiring diagram of the control circuit of the apparatus; and FIG. 9 is a timer sequence chart indicating the timed functioning of the apparatus.

DESCRIPTION OF THE PREFERRED EMBODIMENT

Figure 1:
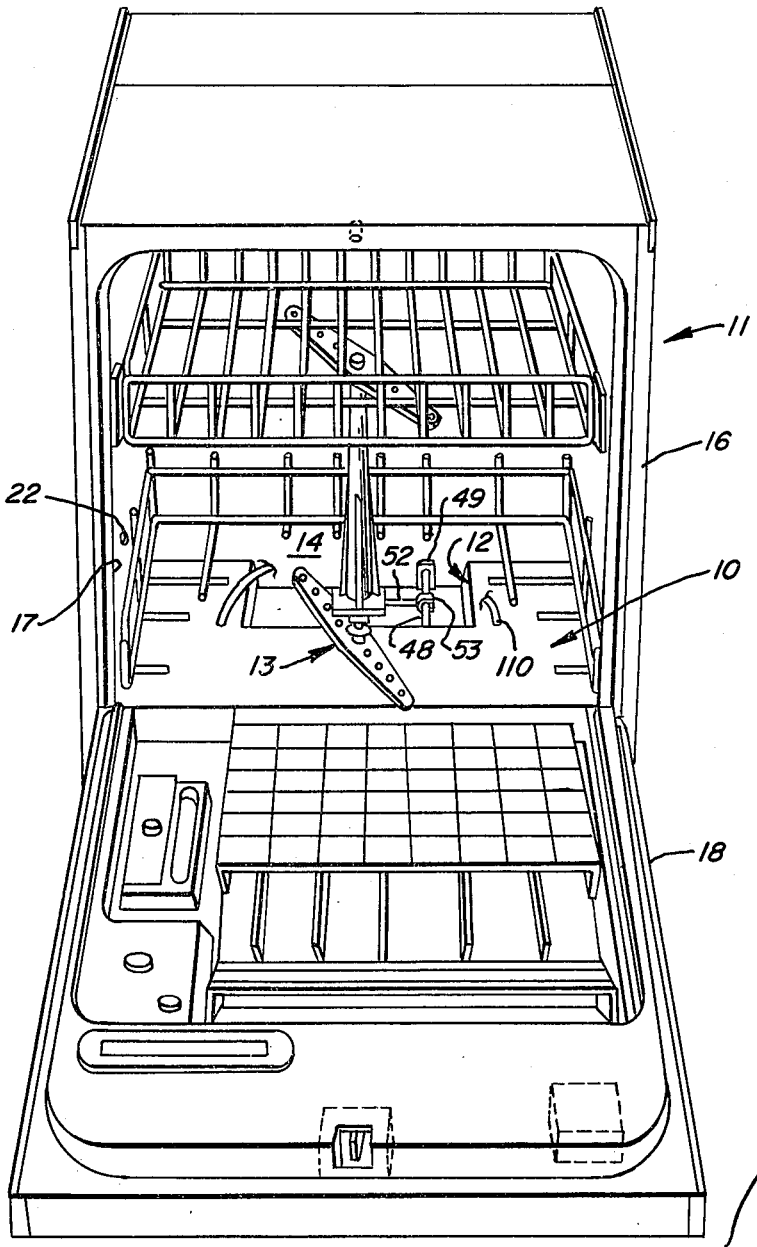
FIG. 1 is a front perspective view of a dishwasher having improved liquid delivery and heating control means comprising the invention.

In the exemplary embodiment of the invention as disclosed in the drawing, a liquid receptacle or tub generally designated 10 illustratively comprises the tub of a dishwasher generally designated 11. The tub includes a sump portion 12 (FIG. 3) adapted to collect the dishwashing liquid for recirculation against the dishes by a suitable spray means generally designated 13 rotated in the dishwashing space 14 by the reaction forces of the liquid supplied to the spray arms by a pump (not shown) driven by an electric motor (not shown).

As shown in FIG. 1, the dishwasher includes an outer housing 16 defining a front opening 17 selectively closed by a door 18.

As further shown in FIGS. 1 and 3, dishwashing liquid is introduced into tub 10 from a pressurized liquid line 19 through a control valve 20 and an inlet line 21 opening into the tub through an inlet opening 22 in one side wall of tub 10. The inlet line 21 includes a vacuum break (not shown) of any conventional type for eliminating any possibility of contamination of the pressurized liquid supply for the dishwasher.

As discussed briefly above, the present invention is concerned with the control of heating in the tub, and, more specifically, is concerned with preventing undesirable overheating of the liquid or the tub in the event of a low level or absence of liquid condition therein.

The present filling control includes two different valve means in the control valve 20 cooperatively preventing undesirable overfill of the tub. More specifically, as shown in FIG. 7, control valve 20 includes a body 23 defining an inlet connection 24 and an outlet connection 25 at opposite ends of a through passage generally designated 26. The body defines a first valve seat 27 at an upstream portion 28 of flow passage 26, and a second valve seat 29 at a downstream portion 30 of the flow passage.

A first valve means generally designated 31 is provided for controlling, in cooperation with valve seat 27, liquid flow through the upstream portion 28, and a second valve means generally designated 32 is provided for controlling, in cooperation with second valve seat 29, liquid flow through second flow passage portion 30. As seen in FIG. 7, the flow passage between the valve seats 27 and 29, respectively, comprises a rectilinear midportion 26a of the flow passage 26.

Valve means 31 and 32 may be controlled by different types of operators, and in the illustrated embodiment of the invention, valve means 31 is operated by an electrical operator 33 and valve means 32 is operated by a mechanical operator 34.

More specifically, valve means 31 may comprise a diaphragm valve and operator 33 may comprise a solenoid operator carried on a suitable bracket 35 secured to valve body 23 by suitable means, such as screws 36.

As shown in FIG. 7, diaphragm valve 31 is arranged to be opened by the fluid pressure acting thereon from the inlet 24, and is closed by a plunger 37 of solenoid 33 which is biased to the closed position by a suitable spring 38.

Valve means 32 comprises a pin diaphragm valve including an actuator pin 39 and a diaphragm 40 selectively seated on valve seat 29. Diaphragm 40 is urged into the seated, valve-closed, position by an arm 41 bearing against pin 39 and journaled in a suitable bracket 42 secured to valve body 23 by suitable means, such as screws 43. Arm 41 is carried on a distal end 44 of a control rod 45 (see FIG. 2) extending through a side wall 46 of tub sump 12 and journaled therein in a sealed bearing 47. Rod 45 includes an end portion 48 within sump 12 journaled at its distal end in an end bearing 49 on opposite wall 50 of the sump.

A float 51 is secured to rod end portion 48 by a bracket 52 and suitable securing means, such as screw 53.

Figure 2:
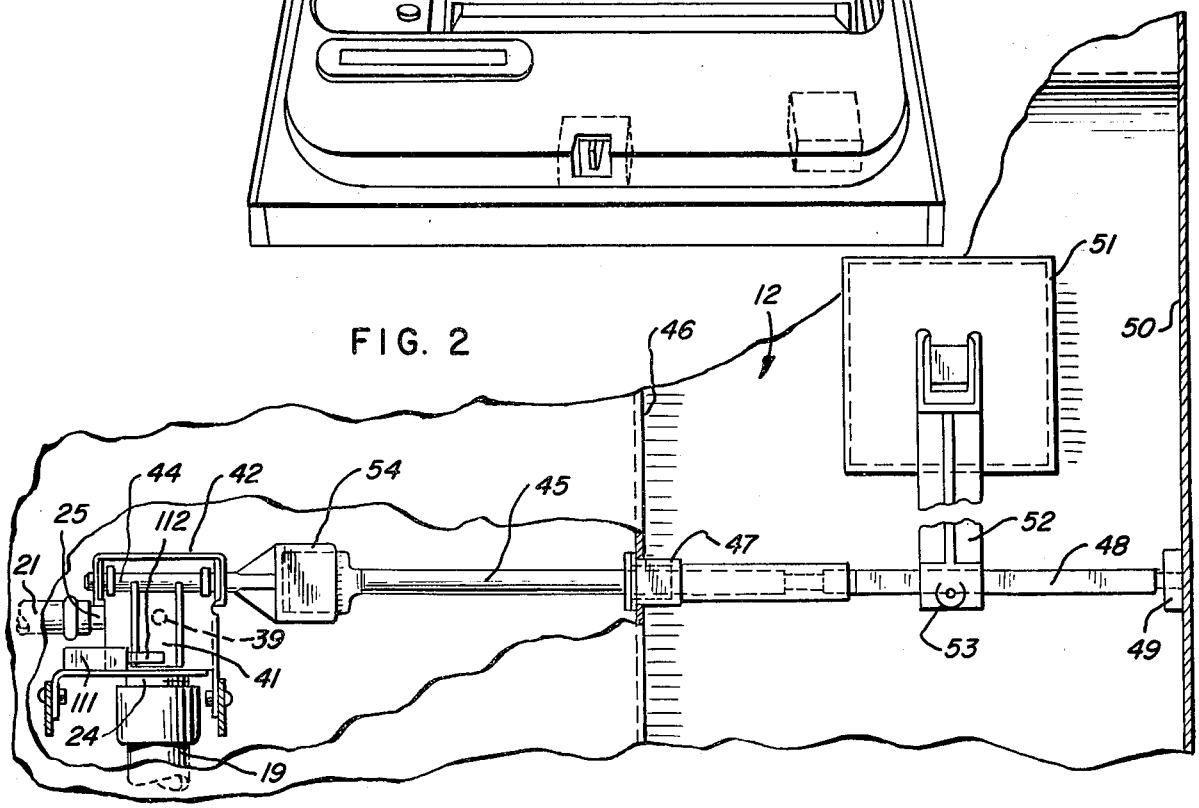
FIG. 2 is a fragmentary, enlarged vertical section showing the improved control means.

A disconnect coupling 54 may be provided on distal end 44 and on rod 45, as illustrated in FIG. 2.

As shown in FIG. 3, solenoid 33 may be controlled by a suitable timer 55 connected to the solenoid by suitable leads 56.

Tub 10 is filled to the desired normal fill or full level by initiation of the filling operation by timer 55. The timer effects a withdrawal of plunger 37 to open valve means 31 and permit fluid pressure acting on diaphragm valve 32 to open the diaphragm valve, permitting the supply liquid to pass outwardly through connector 25 and line 21 to the tub inlet 22.

Timer 55 is set for a delivery time greater than that normally required to fill the tub 10 to the desired full level. The termination of dishwashing liquid delivery into tub 10 is effected by a closing of valve 32 by the float 51 turning rod 45 suitably to depress pin 39 and urge diaphragm 40 into seated engagement with valve seat 29 when the level of liquid in sump 12 reaches a level representative of a preselected desired full level.

Thus, in the event that the float operated control valve means 32 malfunctions and does not stop further delivery of dishwashing liquid into the tub, the valve means 31 will prevent undesirable overfill beyond a maximum preselected or over full level.

Alternatively, should the solenoid valve 31, 33 malfunction so as to maintain valve 31 open, delivery of liquid into tub 10 is normally prevented beyond the normal full level by valve means 32. Thus, each valve functions synergistically in combination with the other valve to provide a desirable overall safety filling of the receptacle effectively positively preventing flooding of the receptacle.

In the dishwasher of the illustrated embodiment of the invention, the pump begins to operate before normal fill is complete and the float 51 will, therefore, sence a level of liquid in the sump that is only representative of the total volume of liquid in the dishwasher tub since a substantial volume of liquid will be present in the dishwasher's liquid distribution system including the spray arms and enroute to contacting the dishes. In such event, if the pump becomes inoperative prior to a completion of the normal fill, the float operated second valve means 32 will interrupt the fill as all the liquid in the tub flows into the sump area. This assumes, of course, that there is sufficient total liquid in the tub when the pump stops to fill the sump under static conditions to the level representative of a normal fill volume under dynamic conditions. Should the pump thereafter begin operating once again, the float will drop with the liquid level in the sump and the fill will continue provided the timer 55 has not already timed out to close valve means 31.

As shown in FIG. 1, a heater 110 is provided in dishwashing space 14 rearwardly subjacent the spray means 13 and overlying the sump 12. As shown in FIG. 3, a float responsive override switch 111 may be disposed adjacent control arm 41. Switch 111 includes an actuator 112, which, as shown in FIGS. 4 and 6, overlies the control arm 41 so that switch 111 is opened when the control arm is rotated upwardly from the position of FIG. 3 by the float 51 being below a minimum position as a result of a low level condition in the sump. Switch 111 is connected to control heater 110 and, thus, causes de-energization of the heater under such low level conditions. Switch 111 comprises a normally closed switch and, thus, when the level of liquid in the sump is above said minimum level, the control arm 41 is rotated to below the actuator 112 to permit controlled cyclical energization of the heater in the normal manner.

Referring now to FIG. 8 of the drawing, operation of the dishwashing apparatus 11 is controlled by a suitable electrical control generally designated 113. As shown therein, the control may be powered from power supply leads L1 and N which may have a grounded third lead G. Power is delivered to the control through a normally open, single pole, single throw door switch 114 connected to a control lead 115 through parallel connected single pole, normally open push-pull switch 116 and bypass switch 117 comprising a first switch of a conventional control timer 55 including a timer motor 118.

A drive motor generally designated 119 is provided for operating the pump for pumping liquid through spray means 13 and is connected to control lead 115 from power supply lead N through a second normally open timer switch 120. In parallel with the second timer switch 120 is a manually selectable single pole, normally closed "Wash Only" switch 121.

The timer motor 118 is connected to the power supply lead N and connected through a series connected pair of timer switches, including a third timer-operated switch 122 and a fourth timer switch 123 to the control lead 115. A single pole, normally closed "Hi Temp. Rinse" switch 124 is connected in parallel with switch 123 and a single pole, normally closed "Extended Wash" switch 125 is connected in parallel with switch 122.

The heater 110 comprises a conventional electric heater connected from power supply lead N through the switch 111 and a safety thermostat switch 126 and a fifth timer switch 127, comprising the timer-controlled heater switch, to control lead 115. More specifically, as seen in FIG. 8, switch 111 is connected to a fixed contact 126*a* of thermostat switch 126 and heater switch 127 is connected to the moving contact 126*b* of thermostat switch 126. A second fixed contact 126*c* of switch 126 is connected to timer motor 118 and to a fixed contact 111*a* of float controlled switch 111. The switch 111 further includes a second fixed contact 111*b* connected to heater 110 and a moving contact 111*c* connected to fixed contact 126*a* of switch 126.

The apparatus further includes a drain solenoid 128 connected from power supply lead N through a sixth timer switch 129 to control lead 115 and a fill valve solenoid 33 connected from power supply lead N through a seventh timer switch 130 to control lead 115.

The timer controls the solenoid 33 so as to terminate delivery of water to the dishwasher tub at the end of a preselected period of timer motor run time in the event the fluid does not close the upper valve 32 prior to the end of the timer fill period. Thus, the timer operated control of the fill solenoid 33 is a backup to the level sensing function of the float in controlling the filling of the tub. The liquid level sensed by float 51 is a rough indication of the total volume of liquid in the dishwasher tub as the timer motor normally causes operation of the dishwasher pump prior to the completion of the fill cycle. Thus a portion of the water in the dishwasher is being sprayed while the float is sensing the level of the returned water to the sump. Thus, when the timer causes termination of the pump operation, the liquid level in the sump rises to above the preselected "Full" level.

As indicated above, float 51 controls the switch operating arm 41 so as to permit the switch to close when the level rises to the preselected "Full" level and, thus, as seen in FIG. 8, moving contact 111*c* engages fixed contact 111*b* to energize heater 110.

As indicated above, switch 111 comprises a single pole, double throw switch so that upon opening of the circuit from heater 110, moving contact 111*c* engages fixed contact 111*a* to provide a circuit through timer motor 118 and thereby maintain operation of the timer motor notwithstanding de-energization of the heater as resulting from a low liquid level in the tub. It is desirable to cause the dishwasher to go through the full overall operation cycle notwithstanding the deenergization of the heater so as to prevent stalling of the dishwasher at the time the low liquid level condition is sensed. More specifically, as shown in FIG. 8, the timer motor is normally maintained energized through the "Extended Wash" switch 125 and the "Hi Temp. Rinse" switch 124. In the event either of these operations is selected by the user so as to open either of these switches, the timer motor 118 would be permanently de-energized were it not for the established connection thereof to control lead 115 through heater switch contacts 111*a* and 111*c*. The circuit from timer motor 118 through switch contacts 126*c*, 126*b* of safety thermostat switch 126 will be in the position of FIG. 8 when the temperature of the water in the tub drops because of the de-energization of heater 110, thus requiring a bypassing of switch contacts 126*c* and 126*b* to maintain the energization of timer motor 118 through either of switches 124 or 125.

The timed operation of the different switch contacts through a typical normal cycle of operation is shown in FIG. 9. In the chart of FIG. 9, a heavy line segment indicates the closed condition of the switch. Thus, as shown in FIG. 9, the heater switch 127 in series with the heater is closed during certain portions of the cycle to make possible heating of the water in the dishwasher tub during those portions of the overall operation cycle of the dishwasher. As indicated above, the use of the float operated single pole, double throw switch 111 permits the control timer motor to time out the entire cycle notwithstanding a low level condition of the liquid in the dishwasher which causes heater switch 111 to be open.

Thus, the present invention provides further improved operation of a dishwasher apparatus wherein a float switch not only terminates delivery of fill liquid when the volume of liquid in the dishwasher reaches a preselected maximum level, but also prevents operation of the heater in the event of the volume of liquid in the dishwasher either not reaching or subsequently dropping below a preselected level during operation of the apparatus. By so preventing or interrupting energization of the heater under low level conditions, damage to the dishwasher tub, which conventionally may be formed of a heat-susceptible synthetic resin, such as a material from the polypropylene family, or damage to the heater means itself, is effectively prevented.

Although the specific structure and detailed operation of the embodiment just described presents a preferred form of the invention herein, it should be understood that the invention also comprehends the embodiment wherein time dependent means, such as a timer-controlled valve means, is designed to terminate the fill at the end of a preselected period representative of a normal fill, and liquid level dependent means, such as a float-operated valve means, operates to prevent overfilling of said receptacle beyond a preselected maximum over full level.

The apparatus of the present invention is extremely simple and economical of construction, while providing the highly desirable features discussed above.

The foregoing disclosure of specific embodiments is illustrative of the broad inventive concepts comprehended by the application.

We claim:

1. In an apparatus having a liquid holder receptacle, fill means for delivering liquid to the receptacle from a pressurized supply, and heater means for heating liquid in the receptacle, improved control means for controlling the operation of the fill means and the heater means, comprising: level sensing means for sensing the volume of liquid in said receptacle; timer means for controlling the fill means to provide a preselected filling of the receptacle to a preselected level above a full level and cyclically energizing said heater means; means responsive to said level sensing means for preventing delivery of liquid to said receptacle whenever said sensed liquid volume is above said full level; and switch means further responsive to said level sensing means for preventing energization of said heater means by said timer means whenever said sensed liquid volume is below a preselected minimum below said full level.

2. The apparatus of claim 1 wherein said level sensing means comprises a float in said receptacle.

3. The apparatus of claim 1 wherein said level sensing means senses a level of the liquid in the receptacle corresponding to said volume of liquid.

4. The apparatus of claim 1 wherein said control means further effects an overall cyclical operation of the apparatus, and said timer means comprises a timer motor and means for terminating said overall operation of the apparatus.

5. The apparatus of claim 1 wherein said means responsive to said level sensing means comprises linkage means connecting said level sensing means to said fill means.

6. The apparatus of claim 1 wherein said control means further effects an overall cyclical operation of the apparatus, and said timer means comprises a timer motor and means for terminating said overall operation of the apparatus, said switch means further comprising means for preventing discontinuation of operation of said timer means until the end of said overall operation of the apparatus.

7. In an apparatus having a liquid holder receptacle, fill means for delivering liquid to the receptacle from a pressurized supply, and heater means for heating liquid in the receptacle, improved control means for controlling the operation of the fill means and the heater means, comprising: level sensing means for sensing the volume of liquid in said receptacle; timer means for controlling the fill means to provide a preselected filling of the receptacle to a preselected level above a full level, and effecting operation of the apparatus through an overall operation cycle in which said heater means is cyclically energized; means responsive to said level sensing means for preventing delivery of liquid to said receptacle whenever said sensed liquid volume is above said full level; and switch means further responsive to said level sensing means preventing energization of said heater means while permitting a continuous running of said timer means to complete said overall operation cycle notwithstanding said sensed liquid volume dropping to below a preselected minimum below said full level.

8. The apparatus of claim 7 wherein said switch means further causes said heater means to be de-energized whenever the liquid volume level is below said preselected minimum.

9. The apparatus of claim 7 wherein said receptacle is formed of heat-susceptible material, such as synthetic resin, and said switch means further causes said heater means to be de-energized whenever the liquid volume level is below said preselected minimum to prevent damage to said receptacle by said heater means.

10. The apparatus of claim 7 wherein said switch means further includes means for controlling operation of said heater means.

11. The apparatus of claim 7 wherein the control includes a manually operable switch for providing an extended wash cycle, said manually operable switch being connected to the timer means to permit operation of the timer means in a closed condition thereof, and said switch means is arranged to maintain continued operation of the timer means notwithstanding arrangement of the manually operable switch in an open condition.

12. The apparatus of claim 7 wherein the control includes a manually operable switch for providing a high temperature rinse cycle, said manually operable switch being connected to the timer means to permit operation of the timer means in a closed condition thereof, and said switch means is arranged to maintain continued operation of the timer means notwithstanding arrangement of the manually operable switch in an open condition.

13. In an apparatus having a liquid holder receptacle, fill means for delivering liquid to the receptacle from a pressurized supply, and heater means in said receptacle for heating liquid in the receptacle, improved control means for controlling the operation of the fill means and the heater means, comprising means for causing the apparatus to proceed through a full normal cycle of operation thereof with energization of the heater means being cyclically effected while preventing energization of the heater means at all times while the level of liquid in the receptacle is below a preselected minimum level thereby to prevent high heat damage to the receptacle and heater means.

14. The apparatus of claim 13 wherein said control means includes a float for sensing the level of liquid in said receptacle.

15. The apparatus of claim 13 wherein said control means includes a timer for controlling the cyclical operation of the apparatus as a function of time.

16. The apparatus of claim 13 wherein said control means includes timer means, and switch means for de-energizing the heater means and maintaining energization of the timer means to complete a full cycle of operation of the apparatus in the event said level is below said predetermined minimum level.

17. The apparatus of claim 13 wherein said control means further includes means for preventing the fill means from filling the receptacle to above a preselected maximum level.

18. In an apparatus having a liquid holder receptacle, fill means for delivering liquid to the receptacle from a pressurized supply, and heater means in said receptacle for heating liquid in the receptacle, improved control means for controlling the operation of the fill means and the heater means, comprising timer means for causing the apparatus to proceed through a full normal cycle of operation thereof, and switch means causing said operation to be without energization of the heater means in the event the level of liquid in the receptacle remains below a preselected minimum level during said operation thereby to prevent high heat damage to the receptacle and heater means.

19. The apparatus of claim 18 wherein said control means includes timer means, and switch means for preventing energization of the heater means and maintaining energization of the timer means to complete a full cycle of operation of the apparatus in the event of said level remaining below said preselected minimum level.

* * * * *